US006640152B1

(12) United States Patent
Chen et al.

(10) Patent No.: US 6,640,152 B1
(45) Date of Patent: Oct. 28, 2003

(54) MODELING AND CONTROL OF SHEET WEIGHT AND MOISTURE FOR PAPER MACHINE TRANSITION

(75) Inventors: Shih-Chin Chen, Dublin, OH (US); Timothy F. Murphy, Columbus, OH (US)

(73) Assignee: ABB Automation, Inc., Columbus, OH (US)

( * ) Notice: Subject to any disclaimer, the term of this patent is extended or adjusted under 35 U.S.C. 154(b) by 0 days.

(21) Appl. No.: 09/536,107

(22) Filed: Mar. 24, 2000

(51) Int. Cl.[7] ..... G06F 7/66; G06F 19/00; G05B 13/02; G04F 5/00; D21F 11/00; D21F 13/00; D21F 7/00; D21F 1/06; D21F 7/02

(52) U.S. Cl. ..... 700/128; 700/127; 700/129; 700/52; 700/305; 700/122; 162/198; 162/253; 162/254; 162/259; 162/262

(58) Field of Search ..... 700/127–129, 700/52, 122, 305; 162/13, 100, 198, 253, 254, 259, 262

(56) References Cited

U.S. PATENT DOCUMENTS

| | | | | |
|---|---|---|---|---|
| 3,711,688 A | * | 1/1973 | Stout et al. | 700/128 |
| 3,886,036 A | | 5/1975 | Dahlin | 162/198 |
| 4,500,968 A | | 2/1985 | Bialkowski | 700/128 |
| 5,145,560 A | | 9/1992 | Grenlund | 162/198 |
| 5,191,313 A | | 3/1993 | Galbraith | 340/501 |
| 5,718,060 A | | 2/1998 | Mori | 34/446 |
| 5,944,955 A | * | 8/1999 | Bossen et al. | 162/198 |
| 5,944,957 A | | 8/1999 | Fagerlund | 162/258 |
| 6,080,278 A | * | 6/2000 | Heaven et al. | 162/198 |
| 6,473,670 B1 | * | 10/2002 | Huhtelin | 700/128 |

FOREIGN PATENT DOCUMENTS

| | | |
|---|---|---|
| GB | 1360442 | 7/1974 |
| WO | PCT/FI98/00585 | 1/1999 |
| WO | WO 99/27183 A | 6/1999 |

OTHER PUBLICATIONS

Optical Grade Changes, Heimo Ihalainen and Risto Ritala. Control Systems, 1996. Stockholm, Sweden.

Reducing Grade Change Time Through The Use of Predictive Multi–Variable Control, David McQuillin and Phillip W. Huizinga. Control Systems, 1996, Stockholm, Sweden.

Dynamic Modelling of Paper Machine from Grade Change Data, Smail Menani, Heikki N. Koivo, Taisto Huhtelin and Risto Kuusisto. Control Systems, 1998, Stockholm, Sweden.

(List continued on next page.)

*Primary Examiner*—Leo Picard
*Assistant Examiner*—Ryan Jarrett
(74) *Attorney, Agent, or Firm*—Stevens & Showalter, LLP

(57) ABSTRACT

Headbox transient responses for sheet weight and moisture are modeled as a combination of two sets of time constants and dead time delays. One set represents a shorter delay with faster response dynamics, the fast mode weight and moisture responses, and the other models the longer delay with slower dynamics, the slow mode weight and moisture responses. A weight and/or moisture transient model is then formed for headbox changes by combining the fast mode weight and moisture responses and the slow mode weight and moisture responses. Stock weight and moisture dynamic and delay time models are determined for operation of stock flow of the paper making machine and the stock flow is controlled in accordance with the stock weight and/or moisture models and the headbox weight transient and/or moisture transient model to compensate for weight and moisture changes in a web of paper being manufacture which weight and moisture changes result from headbox changes.

5 Claims, 8 Drawing Sheets

OTHER PUBLICATIONS

Paper Machine Drying Rate. Technical Information Sheet No. 0404–07 of TAPPI, 1989.

Modeling of Paper Machine for Control: Theory and Practice, Shih–Chin Chen. Control Systems, 1992, Stockholm Sweden.

Transition Control of Paper–Making Processes: Paper Grade Change, Timothy F. Murphy and Shih–Chin Chen. IEEE CCA & CACSO, Kohola Coast, Hawaii, Aug. 22–27, 1999.

Modeling of Paper Machines for Control: Theory and Practice, Chen, Shih–Chin. Pulp and Paper Canada, vol. 96, No. 1, 1995.

James River Cuts Grade Change Time with Automated, Predictive Controls, David McQuillin and Phillip W. Huizinga. Pulp and Paper, Sep. 1994.

* cited by examiner

MODELING AND CONTROL OF SHEET WEIGHT AND MOISTURE FOR PAPER MACHINE TRANSITION

BACKGROUND OF THE INVENTION

The present invention relates in general to the control of paper making machines and, more particularly, to modeling and control of sheet weight and moisture for paper machine transitions. While the present invention is generally applicable to control of paper making machines, it will be described herein with reference to control for making grade changes on such machines for which it is particularly applicable and initially being used.

Many paper makers want to make more frequent, faster and smoother grade changes to better adapt their production to market demands. Grade changes typically involve changes of sheet weight, moisture content level, fiber furnish, color, ash content level, and many other paper properties. To change paper properties from one product grade to another usually requires changing chemical additives in the wet-end stock preparation, stock flow, machine speed, headbox settings, steam pressures, and other process variables. Because each of these factors may exhibit different dynamics and have different transport delays during the transition, the machine may take a long time before it settles into a new steady state or the paper sheet may break during the change. The paper produced during a grade change usually does not meet the specifications of either grades of paper and is referred to as un-saleable "broke". Thus, a smoother grade change, which avoids a sheet break and reduces broke, can definitely increase a machine's productivity, particularly for a machine that performs frequent grade changes.

An investigation of grade changes on a paper making machine shows that the problems related to grade change are very complex in nature. Some issues of grade changes are related to the characteristics of a paper machine itself. Others are associated with operational techniques and different operators' approaches. The most common limitations of a paper machine are either machine speed or steam pressures, i.e., the drying capability of the machine, or both. The speed limit or sluggish drying responses may be the main limiting factor for achieving a faster grade change. Occasionally, the wet-end capacity or stock supply can also be the limiting factor. For a machine with a pressurized headbox and Fourdrinier wire, the responsiveness of the headbox and dryline dynamics often are crucial to the performance of a grade change.

Typically, the machine operator's experience and knowledge play a key role in making a grade change. An operator who is lacking in process knowledge or operational experience tends to make the required changes in an uncoordinated sequence and wait for the resulting responses before performing any further adjustments. Since the process dynamics and transport delay timing can be totally out of synchronization for such a changeover, the process may go through a series of unwanted oscillations. In the worst case, a sheet break could occur and the production would be disrupted. Attempted manual corrective actions can prolong a grade change operation or result in an irregular grade change rather than correct such problems. Even with experienced operators, it is common that each operator will do the same grade change with different settings, different execution sequences, and different adjustments through the transitions. Accordingly, there is a need for a standard operational procedure for a well coordinated grade change, which is consistently used by all operators of a machine. The inventors of the present application have recognized that novel modeling and control of headbox transient responses for sheet weight and moisture can significantly improve on paper machine control and can serve as a base for such a standard operational procedure for grade changes.

SUMMARY OF THE INVENTION

The novel modeling and control of headbox transient deviations for sheet weight and moisture of the invention of the present application significantly advance the performance of paper making machines including, for example, during grade changes and speed changes. Applicants have modeled headbox transient responses as a combination of two sets of time constants and dead time delays. One set represents a shorter delay with faster response dynamics, the fast mode moisture and weight transients, and the other models the longer delay with slower dynamics, the slow mode moisture and weight transients. The combination of fast and slow modes forms a basis for controlling weight and moisture transient deviations caused by headbox changes during a paper machine transition. A dynamic and delay time model is determined for operation of a stock valve of the paper making machine and the stock valve is controlled in accordance with the stock valve dynamic model and the transient model of the headbox to compensate for weight and moisture changes which result from headbox changes in a web of paper being manufactured.

DETAILED DESCRIPTION OF THE INVENTION

Figure 1A:
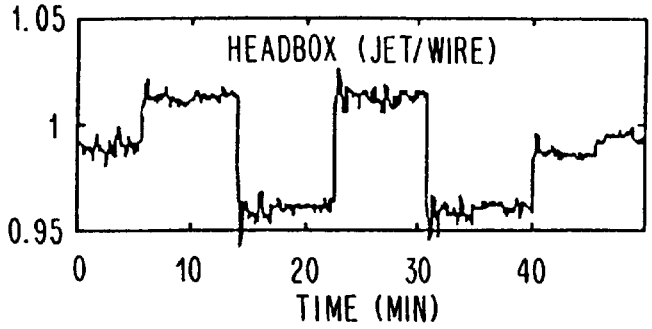
FIGS. 1A–1H are transient responses showing step changes (also known as bumptests) for total head.
Figure 1B:
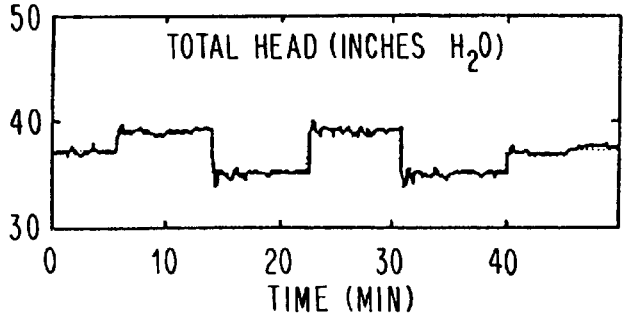
Figure 1C:
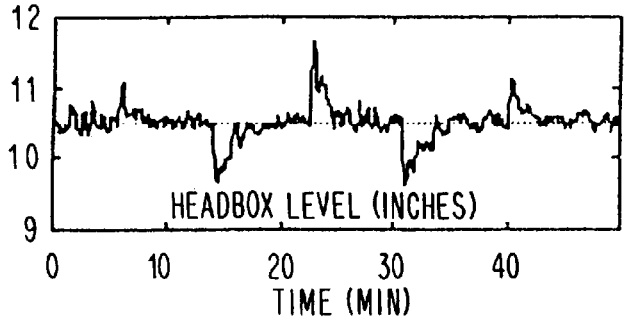
Figure 1D:
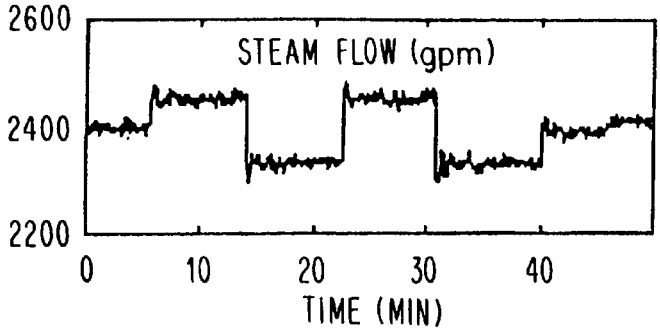

The present invention is generally applicable to control of paper making machines, however, it will be described herein with reference to control for making grade changes, i.e., when a machine is changed over from making a first grade of paper to making a second grade of paper, for which it is particularly applicable and initially being used. From analysis of paper machine dynamics, applicants discovered that the dynamics of different machine variables can be controlled in specific ways to compensate for one another during grade changes on the machines. While a large number of process dynamics or process variables were monitored, the present invention will be described herein with reference to variables which are of primary interest and effect during grade change transitions. These variables include: stock flow, dryer steam pressure, machine speed and headbox liquid level and headbox total head pressure. While control of other variables is contemplated for use in automated grade change operations, the identified variables have primary impact and hence will be described herein to enable automated grade change using the present invention.

The data-logging operations are designed to log process data automatically. Two types of data-logging are implemented: a first data-logger recorded steady-state data and the second data-logger recorded dynamic data during grade change transitions. Ideally, the steady-state data of each process variable for a specific grade is calculated as the average of that process variable over the entire grade run period excluding major upsets such as sheet breaks, invalid measurement or sensor failures. The data-logging operations calculate a running average and the variability (standard deviation) as the machine is operated at each grade. Grade name, grade duration, and starting time are also collected together with all process variables. Presuming that the machine can be operated under similar conditions to produce the same grade of paper, the historical steady-state process data helps establish good approximate operating variable settings for a new grade. To extrapolate the operating conditions for a new grade, models are established from the steady-state process variables. Steady-state modeling will be described hereinafter.

The second data-logger is designed to record process variables during grade change transitions. Thus, the second data-logger captures and stores away process variables every few seconds. The second data-logger immediately became active whenever a grade change was enabled.

One of the most common phenomena during a grade change transition is an irregular weight and moisture change. Typically, the weight and moisture sharply change shortly after the grade change starts and slowly approach their new steady-state levels if the feedback control loops are not enabled to chase after the transient deviations. If the feedback control loops are enabled during the grade change, the feedback controls can be misguided and induce further unwanted process deviations. Such irregular process change was thought to be associated with the transport phenomena that occurred in the dryer section. It was generally believed that the uneven drying, as the result of machine speed change, caused the moisture disturbance during the transition. However, based on experimental tests applicants have performed on paper making machines, the dynamics of headbox total head pressure has been identified as the main source of this type of process disturbance.

A new strategy to reduce these process disturbances relies on changing the stock flow to compensate for the effects of the total head and machine speed changes. This specific approach results in major improvements in stabilizing grade changes in paper making machines. Thus, the present application specifically focuses on modeling and control of transient weight and moisture deviations which occur in the wet-end of a paper machine.

Modeling and control of wet-end weight and moisture transient deviations which result from total head changes are key components of the present invention. Headbox control typically consists of total head, level, and dryline controls (of course there is no level control for a hydraulic headbox). Total head control is mostly driven by paper machine speed in order to maintain a specific jet-to-wire speed ratio (or rush-drag speed difference) target which is crucial to achieve desired paper properties such as formation and fiber orientation. Level control maintains a desirable liquid level in the headbox for sufficient mixing and provides required headbox pressure. Dryline control keeps pulp slurry on the wire for a proper distance to drain. During the steady-state operation when these control loops are maintained at specific settings, there is little indication of the impact of their dynamic operation. However, during a grade change transition, particularly changing the machine speed, the transient responses of these control loops can cause major transient deviations to grade change or speed change transitions.

Step change tests (also known as bump-tests) on total head revealed transient responses on weight and moisture as shown in FIGS. 1A–1H. The bump-test results indicate that a total head change causes both weight and moisture transient deviations for a short period of time, on the order of 7–8 minutes, see FIGS. 1E and 1F. There is no net steady-state change as the result of a total head step change. This transient dynamic has been determined to be the main source of process disturbance that occurs in many grade changes.

Figure 1E:
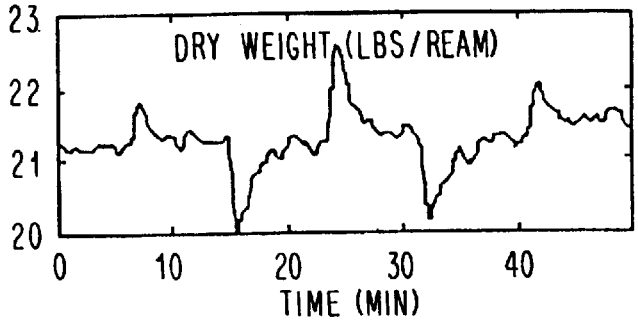
Figure 1F:
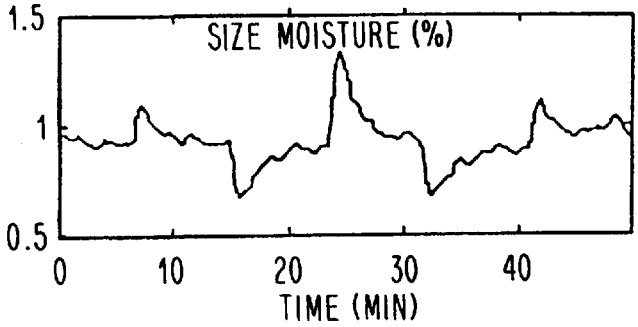
Figure 1G:
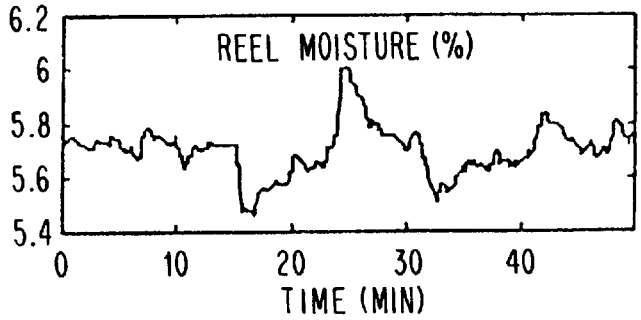
Figure 1H:
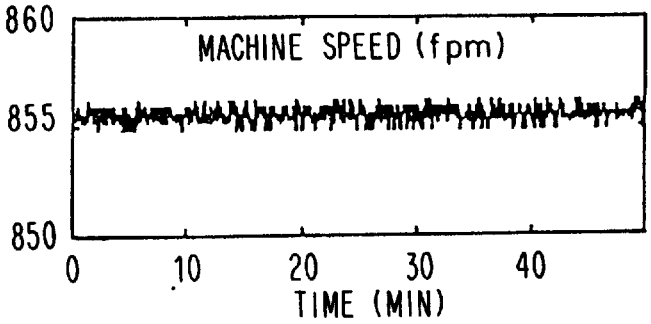
Figure 2:
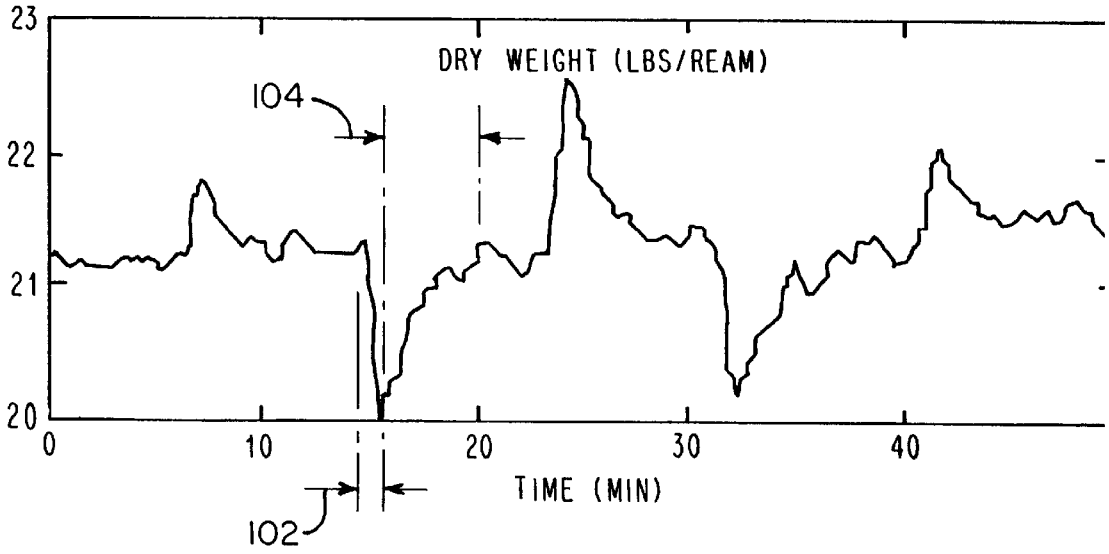
FIG. 2 is the same as FIG. 1E but on a larger scale to show dynamic response on weight of a bump test for total head.

The transient responses of weight and moisture shown in FIGS. 1E and 1F cannot be modeled with a simple first order time constant and dead time delay. The present application models such transient responses as a combination of two sets of dynamics: fast mode and slow mode, 102 and 104 respectively in FIG. 2. Fast mode is modeled with the shorter delay and faster response dynamics and slow mode is represented with the longer delay and slower dynamics. These two modes can be seen in FIG. 2 which is the same as FIG. 1E but on a larger scale. These two modes of responses have the same magnitude of steady-state gain but with opposite signs. Thus, at steady-state, the net impact from a total head change is zero. This model interprets headbox transient behavior very nicely.

The weight w(s) and moisture m(s) transient response models for changes to a total head h(s), $G_h^w(s)$ and $G_h^m(s)$, are expressed as:

$$G_h^w(s) = \frac{w(s)}{h(s)} = g_h^w\left(\frac{e^{-T_{h1}s}}{\tau_{h1}s+1} - \frac{e^{-T_{h2}s}}{\tau_{h2}s+1}\right)e^{-T_{hd}s} \tag{1}$$

$$G_h^m(s) = \frac{m(s)}{h(s)} = g_h^m\left(\frac{e^{-T_{h1}s}}{\tau_{h1}s+1} - \frac{e^{-T_{h2}s}}{\tau_{h2}s+1}\right)e^{-T_{hd}s} \tag{2}$$

where $g_h^w$ and $g_h^m$ are weight (w) and moisture (m) gains with regard to total head change (h), respectively. Notation throughout the present application will show controlled variables subscripted and response variables superscripted which is consistent with the gains $g_h^w$ and $g_h^m$ just defined. $T_{hd}$ is the speed-dependent transport delay (d) with regard to total head change (h). $T_{h1}$ and $\tau_{h1}$ are pure delay and time constant of the faster response mode. $T_{h2}$ and $\tau_{h2}$ are pure delay and time constant of the slower response mode. All these parameters need to be identified from total head bump-tests. It is noted for the bump-test of a headbox total head that weight, moisture, machine speed, rush/drag, and slice (if there is any) feedback control loops have to be put in manual control mode while the bump-test is performed on the total head pressure.

To control transient deviations of weight and moisture caused by a total head change, the grade change transition control aspects of the present application require the dynamic responses of other control variables such as stock flow, steam pressure and machine speed. Bump tests performed on these control variables provide the complete dynamic responses of the process.

As one aspect of the present application, the weight and moisture responses of a stock flow change can be modeled as:

$$G_u^w(s) = \frac{w(s)}{u(s)} = g_u^w \frac{e^{-T_u s}}{\tau_u s + 1} e^{-T_{ud} s} \tag{3}$$

$$G_u^m(s) = \frac{m(s)}{u(s)} = g_u^m \frac{e^{-T_u s}}{\tau_u s + 1} e^{-T_{ud} s} \tag{4}$$

Similarly, the direct weight and moisture responses of a machine speed change are represented as:

$$G_v^w(s) = \frac{w(s)}{v(s)} = g_v^w \frac{e^{-T_v^w s}}{\tau_v^w s + 1} e^{-T_{vd}^w s} \tag{5}$$

$$G_v^m(s) = \frac{m(s)}{v(s)} = g_v^m \frac{e^{-T_v^m s}}{\tau_v^m s + 1} e^{-T_{vd}^m s} \tag{6}$$

Also, the moisture response of a change of steam pressure is:

$$G_p^m(s) = \frac{m(s)}{p(s)} = g_p^m \frac{e^{-T_p s}}{\tau_p s + 1} e^{-T_{pd} s} \tag{7}$$

where u, v, and p represents the changes of stock flow, machine speed and steam pressure changes, respectively.

Collectively, the full dynamic model of a paper machine can be represented as:

$$\begin{bmatrix} w(s) \\ m(s) \\ j(s) \end{bmatrix} = \begin{bmatrix} G_u^w(s) & 0 & G_h^w(s) \\ G_u^m(s) & G_p^m(s) & G_h^m(s) \\ 0 & 0 & G_h^j(s) \end{bmatrix} \begin{bmatrix} u(s) \\ p(s) \\ h(s) \end{bmatrix} + \begin{bmatrix} G_v^w(s) \\ G_v^m(s) \\ G_v^j(s) \end{bmatrix} v(s) \text{ or} \tag{8}$$

$$\begin{bmatrix} w(s) \\ m(s) \\ j(s) \end{bmatrix} = G_1(s) \begin{bmatrix} u(s) \\ p(s) \\ h(s) \end{bmatrix} + G_2(s) v(s) \tag{9}$$

where w(s) is dry weight change(gsm or lb/ream)

m(s) is moisture change(%)

j(s) is jet-to-wire speed ratio or difference change u(s) is stock flow change(lpm or gpm)

p(s) is steam pressure change(psi or pa)

h(s) is the change of total-head pressure in headbox (m or in)

v(s) is machine speed change (meter/min or ft/min) and $$G_h^j(s) = g_h^j \frac{e^{-T_h^j s}}{\tau_h^j s + 1} \tag{10}$$

$$G_v^j(s) = g_v^j \frac{e^{-T_v^j s}}{\tau_v^j s + 1} \tag{11}$$

For a typical paper machine, some of the above parameters are not totally independent. The following conditions are usually true:

$$\tau_u^w = \tau_u^m = \tau_u$$

$$T_u^w = T_u^m = T_u$$

$$T_{h1} < T_{h2}$$

and $$\frac{G_u^w(s)}{G_u^m(s)} = \frac{G_h^w(s)}{G_h^m(s)}$$

i.e.

$$G_u^w G_h^m - G_u^m G_h^w = 0 \tag{12}$$

Non-linearity of valve position to flow rate caused inconsistent machine direction (MD) control performance since the weight response gain varies significantly for different grades. The non-linearity is corrected by adding a look-up table based on the valve characteristic curve. After adding this look-up table, the control is based on a stock flow rate inferred from the table. The flow rate is converted into valve position for display and any valve position change made by an operator is converted into stock flow rate based on the same look-up table. The correction of non-linearity in the stock valve not only enables implementation of successful grade changes, it also directly improves the machine direction (MD) weight control for on-grade regulation.

The grade change transition control aspects of the present application are primarily directed to two areas: control of transient deviations and steady-state modeling. The implementation of transient reduction is applied to total head control, speed change coordination, and grade change coordination. The goal of steady-state modeling is to derive a set of realistic operating conditions for a new grade based on the historical grade data of a paper making machine. Having the historical data of various grades that have been produced by a machine, grade change models can be produced to define the relationship between machine operating conditions and grade targets. Using these models, the present application projects the operating conditions needed to produce a new grade. Using the historical data, a new steam pressure model based on a least squares fit of the static grade change data has been derived.

Static steam pressure change for different grade transition is calculated from the following equation:

$$\Delta p = \frac{1}{g_p^m}(\Delta m) - \frac{g_v^m}{g_p^m}(\Delta v) - \frac{g_u^m}{g_u^w g_p^m}(\Delta w) + \frac{g_v^w g_u^m}{g_u^w g_p^m}(\Delta v). \tag{13}$$

where $g_p^m$, $g_u^m$, and $g_v^m$ are moisture (m) gains with regard to steam pressure, stock flow and machine speed, respectively, and $g_u^w$ and $g_v^w$ are weight (w) gains with regard to stock flow and machine speed, respectively. A least squares estimate for the parameters $g_p^m$, $g_u^m$, and $g_v^m$ can be achieved by rearranging equation (13). This results in $$\Delta p = c_1(\Delta m) - c_2(\Delta v) - c_3\left[\frac{1}{g_u^w}(\Delta w) - \frac{g_v^w}{g_u^w}(\Delta v)\right], \tag{14}$$

which contains three regression coefficients $c_1$, $c_2$, and $c_3$ which are defined as, $$c_1 = \frac{1}{g_p^m},\ c_2 = \frac{g_v^m}{g_p^m},\ \text{and}\ c_3 = \frac{g_u^m}{g_p^m}. \tag{15}$$

The least square error regression yields coefficients $g_p^m$, $g_u^m$, and $g_v^m$. The regression does not try to estimate $g_u^w$ and $g_v^w$. Rather, the parameters $g_u^w$ and $g_v^w$ are calculated from the physical balance of fiber materials on the paper machine. The parameters $g_p^m$, $g_u^m$, and $g_v^m$, identified in equation (15)

are different from those used for regulatory controls and they are used to project the required steam levels for a new grade.

Based on the dynamics of the headbox and stock flow responses, the transient deviations caused by total head changes can be effectively eliminated with an appropriate change to stock flow rate. If $w_h(s)$ is the dry weight response induced by the total head change h(s) and $w_u(s)$ is the dry weight response compensated from the stock flow adjustment $u_h(s)$, then $$w_h(s) = G_h^w(s)h(s) = g_h^w\left(\frac{e^{-T_{h1}s}}{\tau_{h1}s+1} - \frac{e^{-T_{h2}s}}{\tau_{h2}s+1}\right)e^{-T_{hd}s}h(s) \tag{16}$$

and $$w_u(s) = G_u^w(s)u_h(s) = g_u^w\frac{e^{-T_u s}}{\tau_u s+1}e^{-T_{ud}s}u_h(s) \tag{17}$$

The goal of transient compensation is to make $w_h(s)+w_u(s)=0$, i.e., $$w_h(s)+w_u(s)=G_h^w(s)h(s)+G_u^w(s)u_h(s)=0 \tag{18}$$

or $$\frac{u_h(s)}{h(s)} = -\frac{G_h^w(s)}{G_u^w(s)} = -\frac{g_h^w}{g_u^w}\left[\frac{\tau_u s+1}{\tau_{h1}s+1} - \frac{\tau_u s+1}{\tau_{h2}s+1}e^{(T_{h1}-T_{h2})s}\right]e^{(T_u-T_{h1})s}e^{(T_{ud}-T_{hd})s} \tag{19}$$

Since both the total head actuator and the stock valve are located in the wet-end, their speed-dependent transport delays are assumed to be identical, i.e., $T_{ud}=T_{hd}$. The stock valve is usually located further upstream from the location of total head actuator(s) such as fan pump, stream flow valve, or by-pass valve, the dead-time delay $T_u$ is usually greater than $T_{h1}$. To coordinate the changes of u and h, h is delayed by a time interval equal to $T_u-T_{h1}$ and u is changed according to the following transfer function:

$$u_h(s) = -\frac{g_h^w}{g_u^w}\left[\frac{\tau_u s+1}{\tau_{h1}s+1} - \frac{\tau_u s+1}{\tau_{h2}s+1}e^{(T_{h1}-T_{h2})s}\right]h(s)e^{(T_u-T_{h1})s} = C_h^u(s)h(s)e^{(T_u-T_{h1})s} \tag{20}$$

where $$C_h^u(s) = -\frac{g_h^w}{g_u^w}\left[\frac{\tau_u s+1}{\tau_{h1}s+1} - \frac{\tau_u s+1}{\tau_{h2}s+1}e^{(T_{h1}-T_{h2})s}\right]. \tag{21}$$

Similar compenstion can be derived for moisture transient deviation. In practice, the impacts of stock flow and total head changes on weight and moisture are proportionally identical, i.e., $$\frac{g_h^w}{g_u^w} = \frac{g_h^m}{g_u^m}. \tag{22}$$

Accordingly, compensating a total head change with a coordinated stock change can eliminate both weight and moisture transient deviations together.

Figure 3:
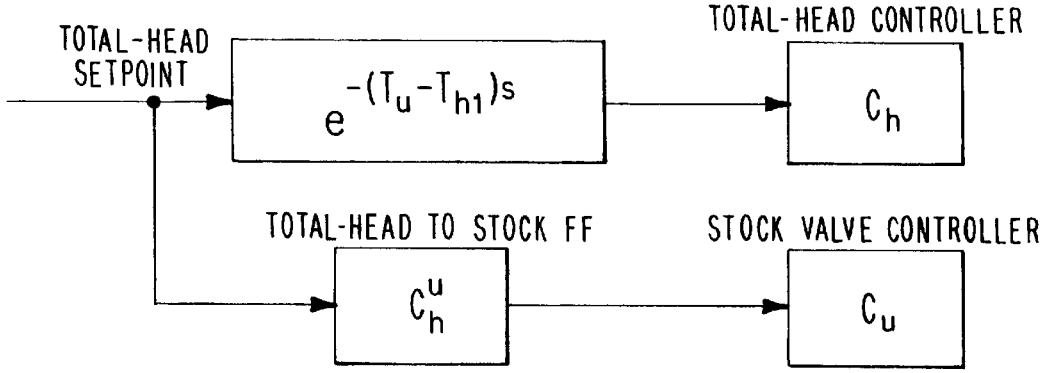
FIG. 3 illustrates the total head coordination control with stock adjustment in accordance with the present invention.

For a request to change total head, the dynamically coordinated stock change should be made at a time equal to $T_u-T_{h1}$ before the total head change. In other words, each total head change shall be delayed by a time $T_u-T_{h1}$ after the compensated stock flow change has begun. The coordinated stock adjustment consists of two parts, one compensates the faster response and the other compensates the slower response. These two parts counteract one another and result in no net steady-state changes to weight or moisture. This execution procedure forms the basis of total head compensation control to eliminate weight and moisture transient deviations. This compensation control is illustrated in FIG. 3. Changes to a slice opening also can cause the same type of transient variations in both weight and moisture as those created by changes in total head. Accordingly, similar coordination between the slice opening and the stock valve can be implemented to compensate for these variations. The stock flow to total head compensation is key to both speed change coordination and grade change transient reduction.

The main goal of speed change coordination is to maintain undisturbed sheet properties such as weight and moisture while the machine speed is increased or decreased for purposes such as the adjustment of the production throughput. When a machine speed change occurs, the total head pressure in the headbox has to change accordingly in order to maintain a desired jet-to-wire target. The indirect impact of speed on sheet weight and moisture through total head was frequently viewed as a speed change symptom in the past. In the present invention, such variations are treated as a side effect of changes to total head pressure and the aforementioned total head compensation control is applied to eliminate the transient deviations.

As described above for total head compensation control, any request for a total head change has to be delayed by a $T_u-T_{h1}$ time interval in order to let stock compensation first take place. As a result of total head coordination, for any speed change request the actual change to the machine speed also has to be delayed by a $T_u-T_{h1}$ time interval.

For the direct responses from speed change, feedforward (FF) compensation is performed with the coordination such that:

$$w_v(s)+w_u(s)=G_v^w(s)v(s)+G_u^w(s)u_v(s)=0 \tag{23}$$

or $$u_v(s) = -\frac{g_v^w}{g_u^w}\frac{\tau_u s+1}{\tau_v^w s+1}v(s)e^{(T_u+T_{ud}-T_v^w-T_{vd}^w)s} = C_v^u(s)v(s)e^{(T_u+T_{ud}-T_v^w-T_{vd}^w)s} \tag{24}$$

where $$C_v^u(s) = -\frac{g_v^w}{g_u^w}\tau_u s + \frac{1}{\tau_v^w s+1} \tag{25}$$

Depending on the sign of $T_u+T_{ud}-T_v^w-T_{vd}^w$, the coordinated stock change intended to compensate for the direct impacts of a speed change may have to be performed before or after the speed change. Typically, $T_v^w+T_{vd}^w<T_u+T_{ud}$ such that for a speed change request, the stock valve has to be immediately changed in accordance with $u_v(s)=C_v^u(s)v(s)$ and the speed change is delayed for a period of time equal to $T_u+T_{ud}-T_v^w-T_{vd}^w$. The desired total head change should be synchronized with the speed change to maintain the jet-to-wire target. However, the stock flow intended to compensate a desired total head change has to be performed ahead of the actual total head change by a period of time equal to $T_u-T_{h1}$ as described above.

In practice, it is noted that typically $\tau_v^w$ is much smaller than $\tau_u$ such that $u_v(s)$ could be unrealistically aggressive. To achieve a smoother transition, both the speed change v(s)

and the stock change $u_v(s)$ can be shaped with a filter $F_s(s)$ so that the actual changes applied to speed and stock will be:

$$v_f(s)=F_s(s)v(s)$$

where $$F_s(s) = \frac{1}{\tau_s s + 1} \tag{26}$$

and $$u_{vf}(s)=F_s(s)C_v^u(s)v(s)e^{(T_u+T_{ud}-T_vw-T_{vd}w)s} \tag{27}$$

Similarly, if speed has a direct impact on moisture, then the coordination from machine speed to steam pressure will have to be coordinated in a similar manner as:

$$m_v(s)+m_p(s)=G_v^m(s)v(s)+G_p^m(s)p_v(s)=0 \tag{28}$$ or $$p_v(s) = -\frac{g_v^m}{g_p^m}\frac{\tau_p s + 1}{\tau_v^w s + 1}v(s)e^{(T_p+T_{pd}-T_v^m-T_{vd}^m)s} \tag{29}$$

$$= C_v^p(s)v(s)e^{(T_p+T_{pd}-T_v^m-T_{vd}^m)s}$$

where $$C_v^p(s) = -\frac{g_v^m}{g_p^m}\tau_p s + \frac{1}{\tau_v^m s + 1} \tag{30}$$

With the smoothing filter applied to speed change, the corresponding change in steam pressure will be:

$$p_{vf}(s)=F_s(s)C_v^p(s)v(s)e^{(T_p+T_{pd}-T_vm-T_{vd}m)s} \tag{31}$$

Depending on the relative dead-time delays and transport delays of stock to speed and steam to speed, either stock or steam compensation will have to be executed first. For example, if $$T_u+T_{ud}-T_v^w-T_{vd}^w>T_p+T_{pd}-T_v^m-T_{vd}^m \tag{32}$$

then the stock compensation should be executed ahead of the steam compensation by:

$$T_p^u=(T_u+T_{ud}-T_v^w-T_{vd}^w)-(T_p+T_{pd}-T_v^m-T_{vd}^m) \tag{33}$$

Typically, a stock change also causes a moisture response. Therefore, a stock change should be fed forward to steam pressure control to compensate for the impact of the stock change as:

$$m_u(s)+m_p(s)=G_u^m(s)u(s)+G_p^m(s)p_u(s)=0 \tag{34}$$ or $$p_u(s) = -\frac{g_u^m}{g_p^m}\frac{\tau_p s + 1}{\tau_u s + 1}u(s)e^{(T_p+T_{pd}-T_u-T_{ud})s} = C_u^p(s)u(s) \tag{35}$$

where $$C_u^p(s) = -\frac{g_u^m}{g_p^m}\tau_p s + \frac{1}{\tau_u s + 1} \tag{36}$$

and coordination of steam pressure and stock flow is $$T_u^p=T_p+T_{pd}-T_u-T_{ud}. \tag{37}$$

Based on the multi-input and multi-output paper machine model, the generalized coordinated speed change control can be formulated as:

$$\begin{bmatrix} u_v(s) \\ p_v(s) \\ h_v(s) \end{bmatrix} = -G_1^{-1}(s)G_2(s)v(s) =$$

$$-[G_1^{-1}(s)G_2(s)e^{-T_vs}][v(s)e^{T_vs}] = -[G_1^{-1}(s)G_2(s)e^{-T_vs}]v'(s)$$

where $v'(s)=v(s)e^{T_vs}$ or $v(s)=v'(s)e^{-T_vs}$ and $T_v$ is a delay time to make $[G_1^{-1}(s)G_2(s)e^{-T_vs}]$ feasible. v'(s) is the change that activates the coordinated changes applied to stock flow, steam pressure, total-head, and machine speed controllers. Among stock flow, steam pressure, and total-head controllers, one of them immediately receives the change v'(s). The other controllers receive the changes v'(s) following the relative delays. The actual machine change v(s) applied to the speed controller is delayed by $T_v$ duration from v'(s).

In practical applications, some of the lead-lag terms that appear in the above coordination may cause extremely aggressive and unrealistic actions. To reduce such effects, a smoothing function $F_s(s)$ can be added to $\Delta v(s)$ as: $v'(s)=F_s(s)\Delta v$ so that the above coordination is practically feasible.

Figure 4:
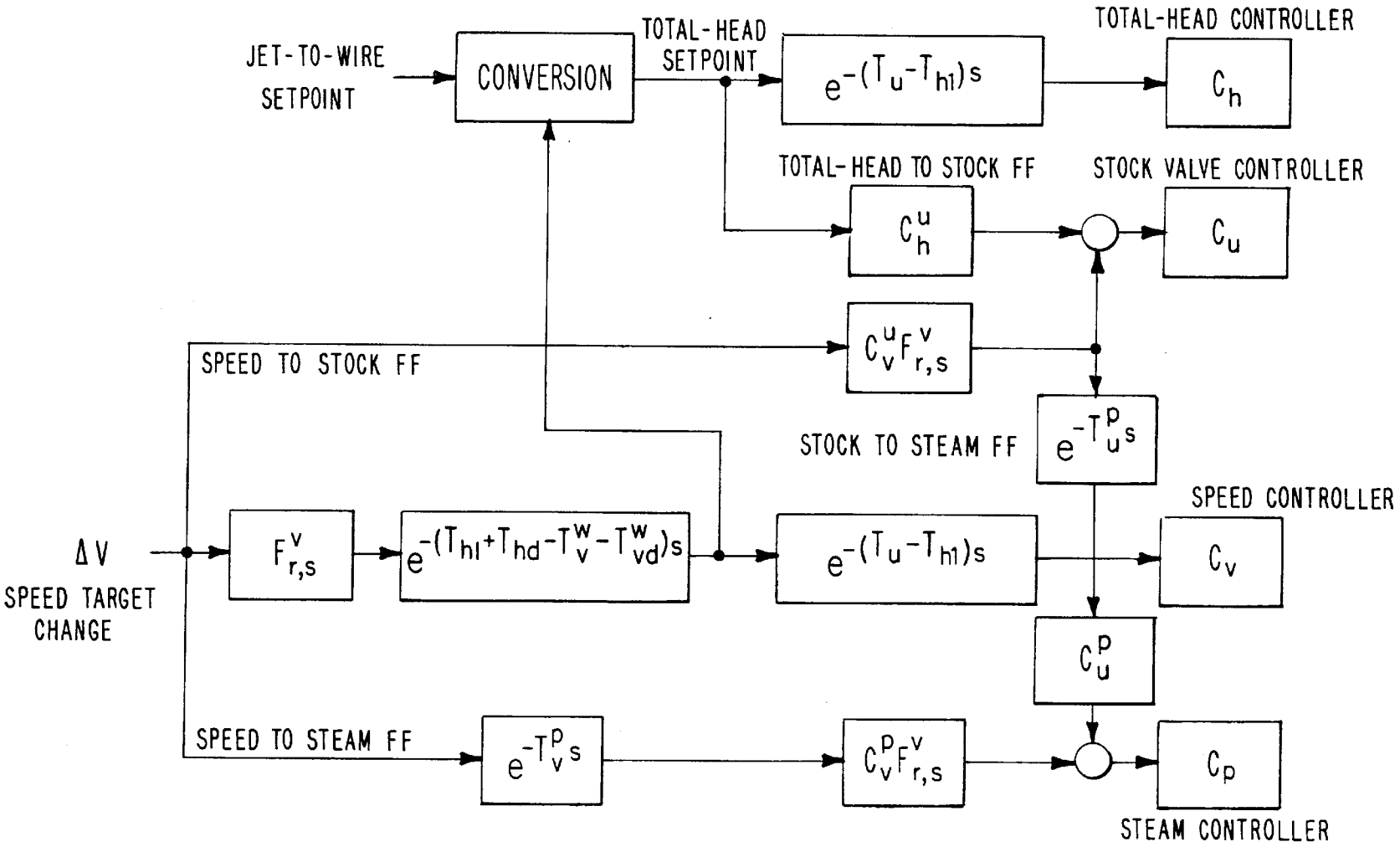
FIG. 4 illustrates a completely coordinated control system including the present invention needed for speed change combined with total head control.

The block diagram of FIG. 4 illustrates a completely coordinated control system needed for speed change combined with total head compensation control.

The ultimate goal of grade change is to achieve a smooth transition while a paper machine is changing from one set of operating conditions to a new set of operating conditions in order to produce a new grade of paper. The coordination among all process variables is more complex than what is needed for speed change coordination. Speed change can be considered a special case of generalized grade change where both weight and moisture targets are unchanged. For a given grade change, the coordination of machine speed with total head, stock flow, and steam pressure is basically the same as the coordination of speed change to total head; however, the weight and/or moisture target changes need additional stock and/or steam adjustments. These additional adjustments are superimposed on top of the machine speed coordination. Presume that r(s) is a master ramp needed for a grade change and all other ramping changes are associated with r(s) as:

$$\Delta w(s)=F_r^w(s)r(s)\Delta w \tag{38}$$

$$\Delta m(s)=F_r^m(s)r(s)\Delta m \tag{39}$$

$$\Delta v(s)=F_r^v(s)r(s)\Delta v \tag{40}$$

$$\Delta j(s)=F_r^j(s)r(s)\Delta j \tag{41}$$

where $$F_r^w(s) = \frac{1}{\tau_r^w s + 1}$$

$$F_r^m(s) = \frac{1}{\tau_r^m s + 1}$$

$$F_r^j(s) = \frac{1}{\tau_r^j s + 1}$$

$$F_r^v(s) = \frac{1}{\tau_r^v s + 1}$$

The coordinated changes to stock flow and steam pressure are:

$$\Delta u(s) = \frac{F_r^w(s)}{G_u^w(s)} r(s)\Delta w - \frac{G_v^w(s)}{G_u^w(s)} F_r^v(s) r(s)\Delta v = C_r^u(s) r(s)\Delta w - C_v^u(s) F_r^v(s) r(s)\Delta v \quad (42)$$

$$\Delta p(s) = \frac{F_r^m(s)}{G_p^m(s)} r(s)\Delta m - \frac{G_v^m(s)}{G_p^m(s)} F_r^v(s) r(s)\Delta v - \frac{G_u^m(s)}{G_p^m(s)} \Delta u(s) = C_r^p(s) r(s)\Delta m - C_v^p(s) F_r^v(s) r(s)\Delta v - C_u^p(s)\Delta u(s) \quad (43)$$

where $$C_r^u(s) = \frac{F_r^w(s)}{G_u^w(s)} \text{ and } C_r^p(s) = \frac{F_r^m(s)}{G_p^m(s)} \quad (44)$$

The first terms in equations 42 and 43 for $\Delta u(s)$ and $\Delta p(s)$ are associated with the target changes in weight and moisture; the second terms are related to speed change; and, the third term in $\Delta p(s)$ is compensation for a stock change. Both the second and third terms have been handled through the speed change coordination. Only the first terms in $\Delta u(s)$ and $\Delta p(s)$ have to be added on to the speed change coordination to get complete grade change coordination.

With the full multi-input and multi-output model, the generalized grade change coordination is represented as:

$$\begin{bmatrix} u(s) \\ p(s) \\ h(s) \end{bmatrix} = \left\{ [-G_1^{-1}(s) G_2(s) e^{-T_v s} F_r^v(s)\Delta v]\,[e^{-(T_r - T_v)s}] + G_1^{-1}(s) \begin{bmatrix} F_r^w(s) e^{-T_r s}\Delta w \\ F_r^m(s) e^{-T_r s}\Delta m \\ F_r^j(s) e^{-T_r s}\Delta j \end{bmatrix} \right\} r'(s) \quad (45)$$

where $r'(s)=r(s)e^{T_r s}$ or $r(s)=r'(s)e^{-T_r s}$ and a delay time $T_r$ is added to make $[G_1^{-1}(s)G_2(s)e^{-T_r s}]$ feasible. The starting ramp r'(s) is the common starting ramp that will activate the required changes to stock flow, steam pressure, total-head, and machine speed controllers. The starting ramp r(s) is the expected ramp of weight, moisture, jet-to-wire ratio, and machine speed.

Figure 5:
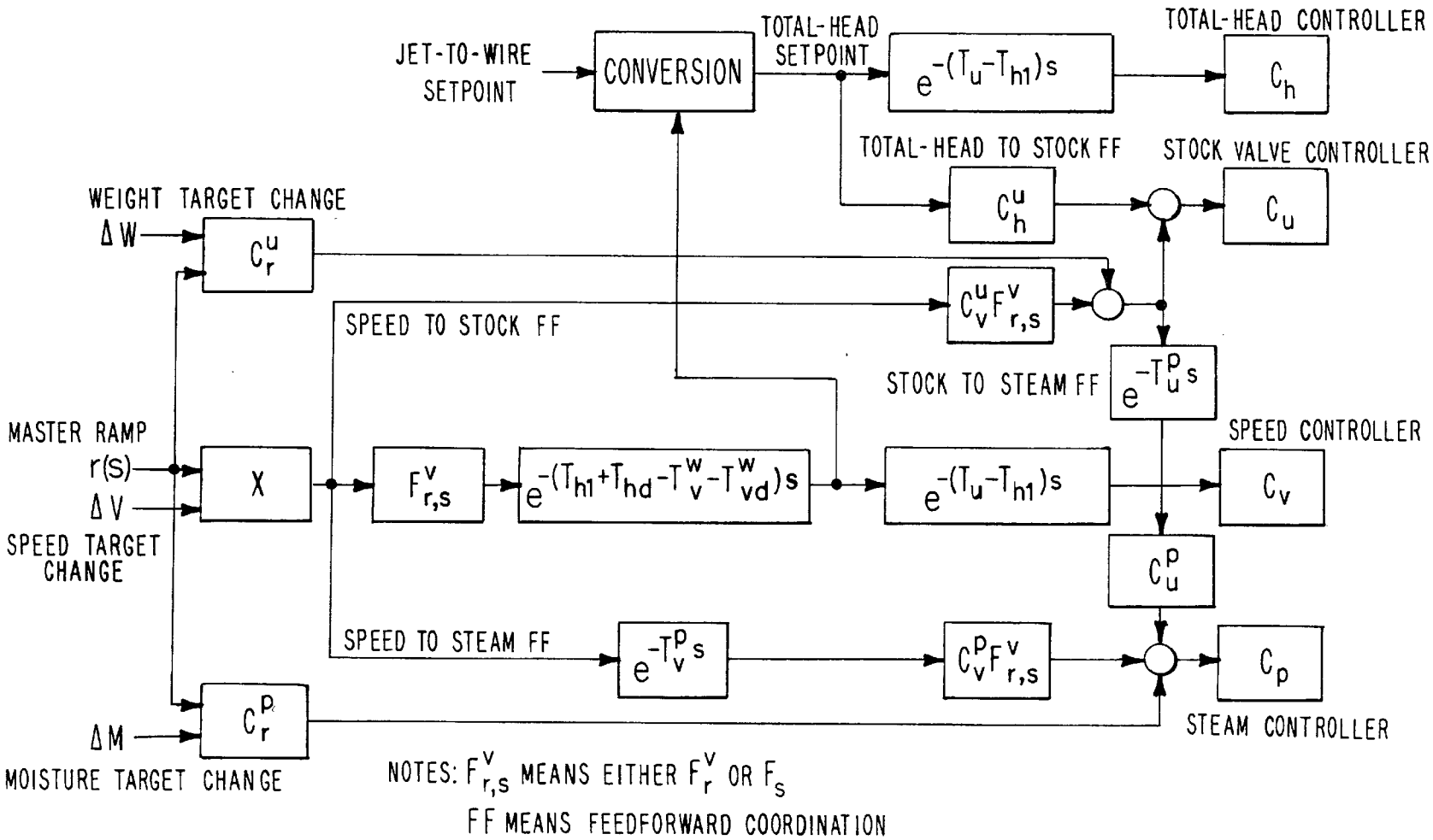
FIG. 5 is a complete block diagram for grade change coordination including the present invention.
Figure 6A:
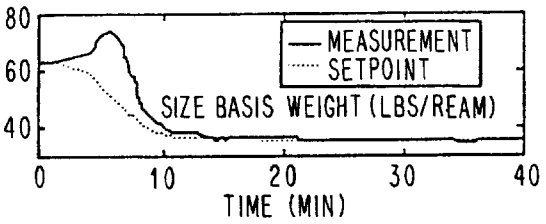
FIGS. 6A–6J and 7A–7J are exemplary waveforms illustrating performance of the disclosed transition control including the present invention.
Figure 6B:
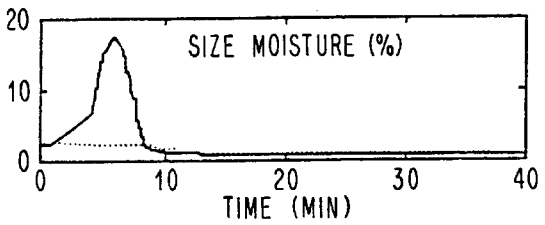
Figure 6C:
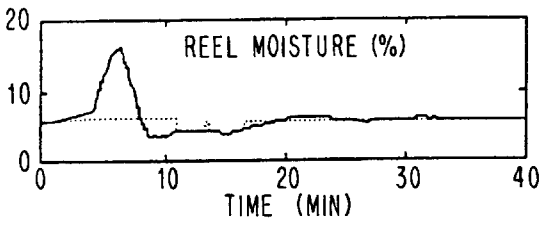
Figure 6D:
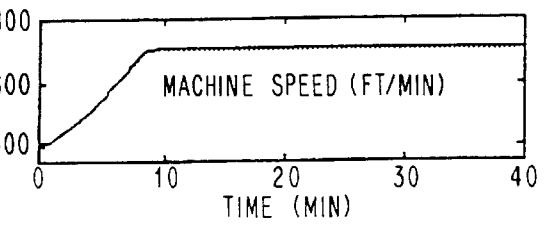
Figure 6F:
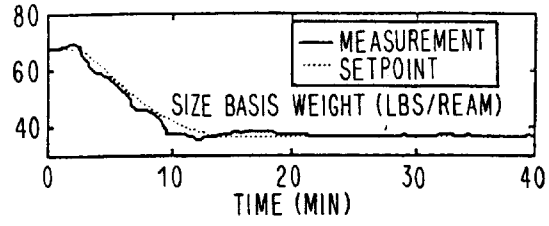
Figure 6G:
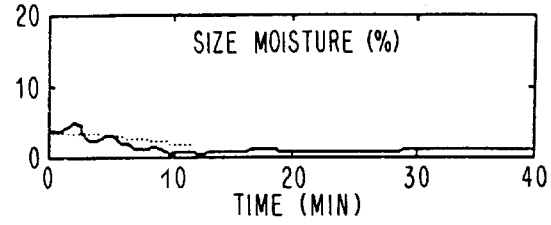
Figure 6H:
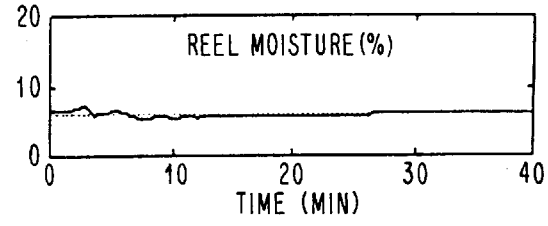
Figure 6I:
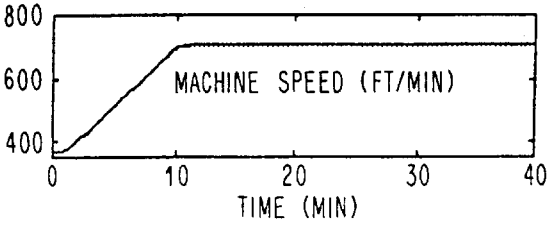
Figure 6E:
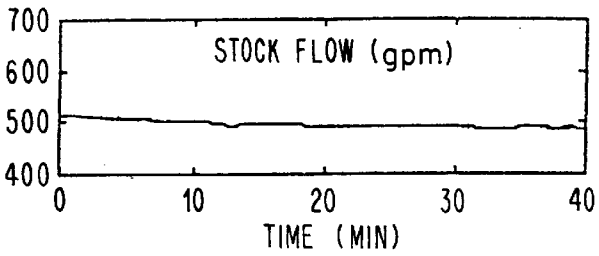
Figure 6J:
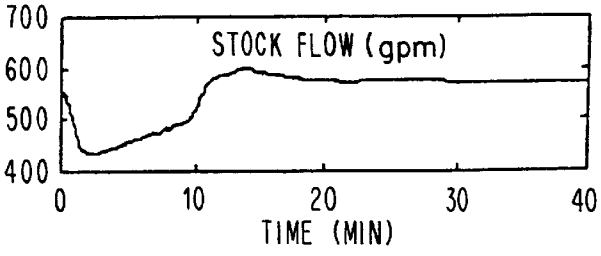
Figure 7A:
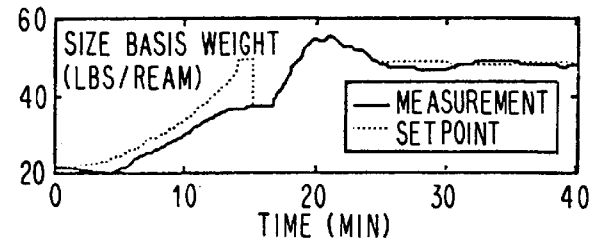
Figure 7F:
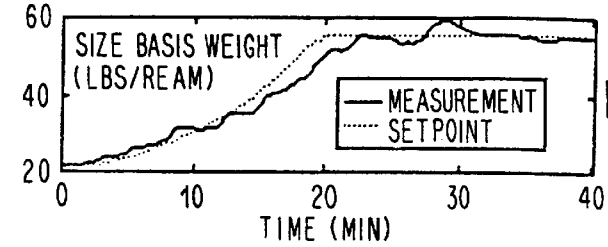
Figure 7B:
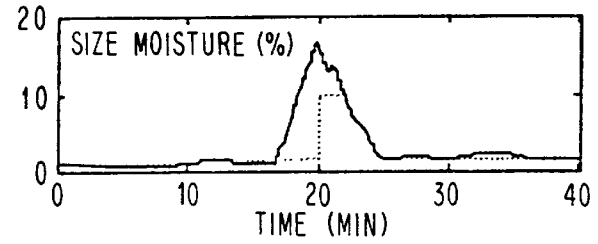
Figure 7G:
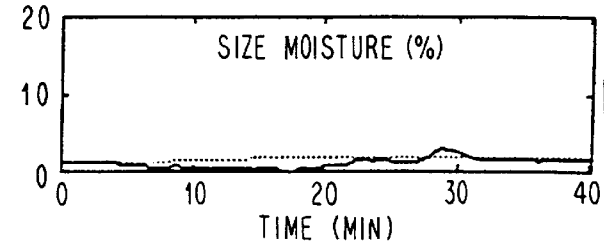
Figure 7C:
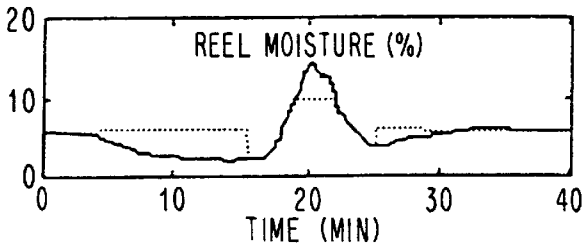
Figure 7D:
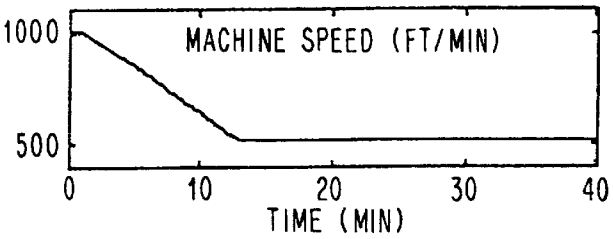
Figure 7E:
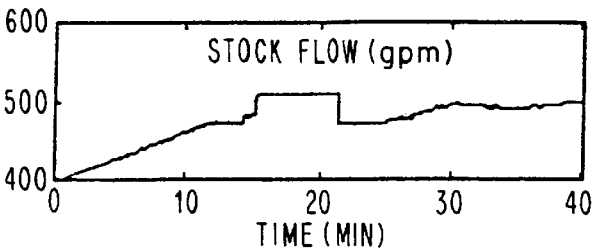
Figure 7H:
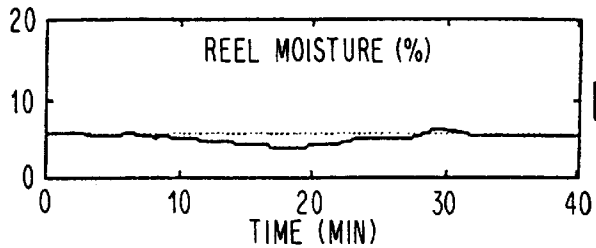
Figure 7I:
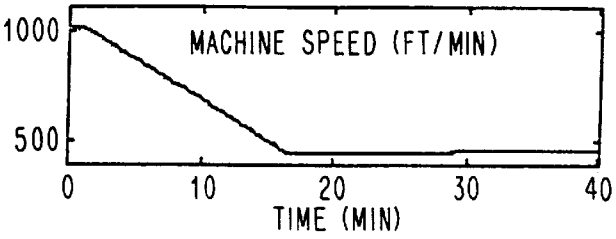
Figure 7J:
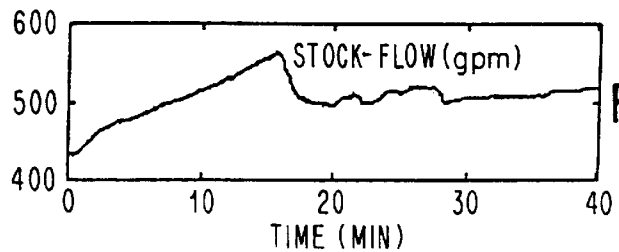

The complete block diagram for grade change coordination is shown in FIG. 5. The generalized formulation and block diagram are illustrated in the appendix.

To simplify the application, the ramping filter can be chosen so that:

$$F_r^w(s) = F_r^m(s) = F_r^v(s) = F_r^j(s) \frac{1}{\tau_r s + 1} \quad (46)$$

where $\tau_r = \max(\tau_u, \tau_v^w, \tau_v^m, \alpha\tau_p)$ $0<\alpha<1$ $\alpha$ is a tuning parameter.

In addition to coordination shown in the block diagram of FIG. 5, it is also important to recognize that the response models in the above equations could change for different operating conditions. Particularly, the response gains and speed-dependent transport delays have to be modified while the stock, steam, and machine speed are moving through the grade change to their new operating conditions.

Performance of the disclosed transition control is illustrated by examples shown in FIGS. 6A–6J and FIGS. 7A–7J. These figures show comparable grade changes made with and without the transition control feature. FIGS. 6A–6J show grade changes with machine speed increases and dry weight decreases with the left hand side, FIGS. 6A–6E, having grade transition control disabled and the right hand side, FIGS. 6F–6J, having grade transition control enabled while FIGS. 7A–7J show grade changes with machine speed decreases and dry weight increases with the left hand side, FIGS. 7A–7E, having grade transition control disabled and the right hand side, FIGS. 7F–7J, having grade transition control enabled. The grade change of FIGS. 7A–7E is comparable in terms of change in machine speed and dry weight to the grade change of FIGS. 7F–7J. The figures, from top to bottom, show the transitions of the basis weight, size-press moisture, reel moisture, machine speed and stock flow. The solid line is the actual measurement and dash line is the target.

In these figures, two comparable grade changes are put together side-by-side for comparison with the major difference being the process variations through the transition. Without grade transition control enabled, weight, size-press moisture, and reel moisture deviate significantly from the target (dash line) during the grade change. With grade transition control enabled, the deviations are substantially reduced. These differences are primarily due to the new compensation that is added to the stock flow at the beginning of each grade change. Comparing the stock flows in both columns of the figures, the additional stock compensation can be seen in the right column, FIGS. 6J and 7J, where the grade change transition control has been enabled. The required timing coordination and the amount of compensation are in accordance with the above description.

Having thus described the invention of the present application in detail and by reference to preferred embodiments thereof, it will be apparent that modifications and variations are possible without departing from the scope of the invention defined in the appended claims.

What is claimed is:

1. A method for modeling and controlling headbox transient responses for weight and moisture of a web of paper being manufactured by a paper making machine, said method comprising the steps of:

determining fast mode weight and moisture responses due to headbox changes;

determining slow mode weight and moisture responses due to headbox changes;

forming headbox weight and moisture transient models for headbox changes as a combination of said fast mode weight and moisture responses and said slow mode weight and moisture responses;

determining stock weight and moisture response models for operation of stock flow of said paper making machine; and controlling said stock flow in accordance with said stock weight and moisture response models and said headbox weight and moisture transient models to compensate for weight and moisture changes in said web of paper resulting from headbox changes.

2. A method for modeling and controlling headbox transient responses for weight and moisture of a web of paper being manufactured by a paper making machine, said method comprising the steps of:

determining fast mode weight and moisture responses due to headbox changes by performing the steps of:

determining weight and moisture responses resulting from a step change applied to said headbox;

setting a time delay for said fast mode weight and moisture responses equal to a first time period extending from said step change applied to said headbox to a time of first weight and moisture responses;

measuring a first rate of change for said weight and moisture responses from an initial value to a peak value; and setting a time constant and process gains for said fast mode weight and moisture responses to correspond to said first rate of change for said weight and moisture responses, determining slow mode weight and moisture responses due to headbox changes;

forming headbox weight and moisture transient models for headbox changes as a combination of said fast mode weight and moisture responses and said slow mode weight and moisture responses;

determining a stock weight and moisture response model for operation of stock flow of said paper making machine; and controlling said stock flow in accordance with said stock weight and moisture response models and said headbox weight and moisture transient models to compensate for weight and moisture changes in said web of paper resulting from headbox changes.

3. A method for modeling and controlling headbox transient responses for weight and moisture of a web of paper being manufactured as claimed in claim 2 wherein said step of determining a slow mode weight and moisture response comprises the steps of:

determining weight and moisture responses resulting from a step change applied to said headbox;

setting a time delay for said slow mode weight and moisture responses equal to a second time period extending from said step change applied to said headbox to a time corresponding to a peak of said weight and moisture responses;

measuring a second rate of change for said weight and moisture responses from a peak value to a steady-state value; and setting a time constant and process gains for said slow mode weight and moisture responses in conjunction with said fast mode weight and moisture response models to correspond to said second rate of change for said weight and moisture responses.

4. A method for modeling and controlling headbox transient responses for weight and moisture of a web of paper being manufactured as claimed in claim 3 further comprising the step of setting said weight transient model due to headbox changes equal to the equation:

$$G_h^w(s) = \frac{w(s)}{h(s)} = g_h^w\left(\frac{e^{-T_{h1}s}}{\tau_{h1}s+1} - \frac{e^{-T_{h2}s}}{\tau_{h2}s+1}\right)e^{-T_{hd}s}$$

and said moisture transient model due to headbox changes equal to the equation:

$$G_h^m(s) = \frac{m(s)}{h(s)} = g_h^m\left(\frac{e^{-T_{h1}s}}{\tau_{h1}s+1} - \frac{e^{-T_{h2}s}}{\tau_{h2}s+1}\right)e^{-T_{hd}s}$$

where $G_h^w(s)$ is transient response of weight with respect to headbox changes, $G_h^m(s)$ is transient response of moisture with respect to headbox changes, w(s) is a transfer function for weight change, m(s) is a transfer function for moisture change, h(s) is a transfer function for the headbox total head change, $g_h^w$ is a weight gain factor, $g_h^m$ is a moisture gain factor, $T_{h1}$ is equal to said first time period, $\tau_{h1}$ is equal to said first rate of change, $T_{h2}$ is equal to said second time period, $\tau_{h2}$ is equal to said second rate of change and $T_{hd}$ is the speed-dependent transport delay.

5. A method for modeling and controlling headbox transient responses for weight and moisture of a web of paper being manufactured as claimed in claim 3 wherein said step of controlling said stock flow to compensate for weight and moisture changes in said web of paper comprises the step of controlling said stock flow in accordance with the transfer function:

$$u_h(s) = -\left[\frac{g_h^w}{g_u^w}\left[\frac{\tau_u s+1}{\tau_{h1}s+1} - \frac{\tau_u s+1}{\tau_{h2}s+1}e^{(T_{h1}-T_{h2})s}\right]e^{(T_u-T_{h1})x}e^{(T_{ud}-T_{hd})x}\right]h(s)_\tau$$

or $$u_h(s) = -\left[\frac{g_h^w}{g_u^m}\left[\frac{\tau_u s+1}{\tau_{h1}s+1} - \frac{\tau_u s+1}{\tau_{h2}s+1}e^{(T_{h1}-T_{h2})s}\right]e^{(T_u-T_{h1})x}e^{(T_{ud}-T_{hd})s}\right]h(s)$$

where $u_h(s)$ is control change applied to said stock flow, $g_h^w$ is a headbox to weight gain factor, $g_u^w$ is a stock flow to weight gain factor, $g_h^m$ is a headbox to moisture gain factor, $g_u^m$ is a stock flow to moisture gain factor, $T_{h1}$ is equal to said first time period, $\tau_{h1}$ is equal to said first rate of change, $T_{h2}$ is equal to said second time period, $\tau_{h2}$ is equal to said second rate of change, $T_u$ is equal to a transport delay between said stock flow and weight, $\tau_u$ is a rate of change between said stock flow and weight, $T_{ud}$ is a speed-dependent transport delay with respect to stock flow change, $T_{hd}$ is a speed-dependent transport delay with respect to total head change, and h(s) is a transfer function for the headbox total head change.

* * * * *

UNITED STATES PATENT AND TRADEMARK OFFICE

CERTIFICATE OF CORRECTION

PATENT NO. : 6,640,152 B1 
DATED : October 28, 2003
INVENTOR(S) : Shih-Chin Chen et al.

It is certified that error appears in the above-identified patent and that said Letters Patent is hereby corrected as shown below:

Column 8,
Line 48, Equation 25, " $C_v^w(s) = -\frac{g_v^w}{g_u^w}\tau_u s + \frac{1}{\tau_v^w s + 1}$ " should read -- $C_v^u(s) = -\frac{g_v^w}{g_u^w}\frac{\tau_u s + 1}{\tau_v^w s + 1}$ --;

Column 9,
Line 28, " $C_v^p(s) = -\frac{g_v^m}{g_p^m}\tau_p s + \frac{1}{\tau_v^m s + 1}$ " should read -- $C_v^p(s) = -\frac{g_v^m}{g_p^m}\frac{\tau_p s + 1}{\tau_v^m s + 1}$ --;

Line 35, Equation 31, " $p_{vf}(s) = F_s(s)C_v^p(s)v(s)e^{(T_p + T_{pd} - T_{vm} - T_{vdm})s}$ " should read
-- $p_{vf}(s) = F_s(s)C_v^p(s)v(s)e^{(T_p + T_{pd} - T_v^m - T_{vd}^m)s}$ --;

Line 60, Equation 36, " $C_u^p(s) = -\frac{g_u^m}{g_p^m}\tau_p s + \frac{1}{\tau_u s + 1}$ " should read -- $C_u^p(s) = -\frac{g_u^m}{g_p^m}\frac{\tau_p s + 1}{\tau_u s + 1}$ --;

Column 14,
Lines 32-36, $u_h(s) = -\left[\frac{g_h^w}{g_u^w}\left[\frac{\tau_u s + 1}{\tau_{h1} s + 1} - \frac{\tau_u s + 1}{\tau_{h2} s + 1}e^{(T_{h1} - T_{h2})s}\right]e^{(T_u - T_{h1})s}e^{(T_{ud} - T_{hd})s}\right]h(s)_\tau$ or $u_h(s) = -\left[\frac{g_h^w}{g_u^m}\left[\frac{\tau_u s + 1}{\tau_{h1} s + 1} - \frac{\tau_u s + 1}{\tau_{h2} s + 1}e^{(T_{h1} - T_{h2})s}\right]e^{(T_u - T_{h1})s}e^{(T_{ud} - T_{hd})s}\right]h(s)$

UNITED STATES PATENT AND TRADEMARK OFFICE

CERTIFICATE OF CORRECTION

PATENT NO. : 6,640,152 B1
DATED : October 28, 2003
INVENTOR(S) : Shih-Chin Chen et al.

It is certified that error appears in the above-identified patent and that said Letters Patent is hereby corrected as shown below:

Column 14, cont'd.,
should read $$u_h(s) = -\left[\frac{g_h^w}{g_u^w}\left[\frac{\tau_u s+1}{\tau_{h1}s+1} - \frac{\tau_u s+1}{\tau_{h2}s+1}e^{(T_{h1}-T_{h2})s}\right]e^{(T_u-T_{h1})s}e^{(T_{wd}-T_{hd})s}\right]h(s)$$

or $$u_h(s) = -\left[\frac{g_h^m}{g_u^m}\left[\frac{\tau_u s+1}{\tau_{h1}s+1} - \frac{\tau_u s+1}{\tau_{h2}s+1}e^{(T_{h1}-T_{h2})s}\right]e^{(T_u-T_{h1})s}e^{(T_{md}-T_{hd})s}\right]h(s)$$

Signed and Sealed this

Twentieth Day of July, 2004

JON W. DUDAS
*Acting Director of the United States Patent and Trademark Office*